US010415920B2

(12) United States Patent
Haskell et al.

(10) Patent No.: US 10,415,920 B2
(45) Date of Patent: Sep. 17, 2019

(54) SYSTEMS AND METHODS FOR PROVIDING A LIGHTWEIGHT FIREARM ACCESSORY TO ENHANCE STABILITY OF THE FIREARM IN SHOOTING POSITIONS

(71) Applicant: BATTLEMENT DEFENSE LLC, Hailey, ID (US)

(72) Inventors: Nathaniel Hopkins Haskell, Hailey, ID (US); Michael Hunt, Woodstock, GA (US)

( * ) Notice: Subject to any disclaimer, the term of this patent is extended or adjusted under 35 U.S.C. 154(b) by 0 days.

(21) Appl. No.: 15/871,934

(22) Filed: Jan. 15, 2018

(65) Prior Publication Data

US 2018/0202747 A1 Jul. 19, 2018

Related U.S. Application Data

(60) Provisional application No. 62/446,511, filed on Jan. 15, 2017.

(51) Int. Cl.
*F41A 23/10* (2006.01)
*F41A 23/16* (2006.01)

(52) U.S. Cl.
CPC ..... *F41A 23/10* (2013.01); *F41A 23/16* (2013.01)

(58) Field of Classification Search
CPC ..... F41A 23/10; F41A 23/08
USPC ..... 42/94
See application file for complete search history.

(56) References Cited

U.S. PATENT DOCUMENTS

| | | | | |
|---|---|---|---|---|
| 4,776,124 | A * | 10/1988 | Clifton | F41A 23/08 42/94 |
| 7,578,090 | B1 * | 8/2009 | Romaszka | F41C 27/16 42/85 |
| 7,770,320 | B1 * | 8/2010 | Bartak | F41C 23/16 42/72 |
| 8,458,946 | B1 * | 6/2013 | Pintsch | F41A 23/08 42/90 |
| 8,898,948 | B1 * | 12/2014 | Gaddini | F41G 11/003 42/71.01 |
| 9,689,637 | B1 * | 6/2017 | Beltz | F41A 23/02 |
| 9,784,521 | B2 * | 10/2017 | Bartak | F41A 23/10 |
| 2007/0079541 | A1 * | 4/2007 | Peterson | F41A 23/08 42/94 |
| 2009/0126250 | A1 | 5/2009 | Keng | |
| 2011/0126444 | A1 | 6/2011 | Keng et al. | |
| 2013/0174463 | A1 * | 7/2013 | Hinds | F41A 23/04 42/94 |

(Continued)

*Primary Examiner* — Reginald S Tillman, Jr.
(74) *Attorney, Agent, or Firm* — TannerIP PLLC; Daniel A. Tanner, III; James E. Golladay, II

(57) ABSTRACT

A detachable firearm accessory is provided to enhance stability of a shooting position when attached to the forestock of a firearm. Configurations of a detachable leg bipod system or device provide for the legs of the bipod system or device to be removable and separately stowable with the bipod system, or apart from the bipod system, in order to potentially reduce the weight, and/or streamline the protruding profile/parts, of the bipod system or device remaining attached to the forestock of the firearm for carriage. Removability of the legs may otherwise enhance or increase the flexibility for the shooter in his or her ability to differentially employ the particularly-configured base or connection portion of the bipod system or device, apart from the legs, as one or more of a barricade stop, or a sill or frame saddle stop.

19 Claims, 3 Drawing Sheets

(56) References Cited

U.S. PATENT DOCUMENTS

| | | | | |
|---|---|---|---|---|
| 2015/0096216 | A1 | 4/2015 | Hughes | |
| 2015/0204479 | A1* | 7/2015 | Bryant | F16M 11/041 348/376 |
| 2015/0362278 | A1 | 12/2015 | Genchel et al. | |
| 2016/0116245 | A1 | 4/2016 | Ravnaas | |
| 2016/0209172 | A1 | 7/2016 | Trotabas | |
| 2016/0223132 | A1 | 8/2016 | Moody et al. | |

* cited by examiner

SYSTEMS AND METHODS FOR PROVIDING A LIGHTWEIGHT FIREARM ACCESSORY TO ENHANCE STABILITY OF THE FIREARM IN SHOOTING POSITIONS

This application claims the benefit on U.S. Provisional Patent Application No. 62/446,511 entitled "Detachable Leg BiPod," filed on Jan. 15, 2017, the disclosure of which is hereby incorporated by reference herein in its entirety.

BACKGROUND

1. Field of the Disclosed Embodiments

This disclosure is directed to a detachable firearm accessory that is usable to enhance stability of a shooting position, particularly when attached to the forestock of a firearm, and to unique configurations of a detachable leg bipod system or device for mounting via a compatible rail, or other attachment point, on the forestock of the firearm.

2. Related Art

Virtually any manner by which a shooter can stabilize the forestock of a rifle, man-portable machine gun, or other "long" gun will aid in shooting accuracy. Many different methods are employed in range scenarios for accuracy evaluation of the firearms including setting the forestock in some manner of fixed frame or vise, or on sandbags on a floor or a bench. These methods are, however, generally impractical when the shooter transitions from the controlled range scenarios into the field for operational employment.

Accessories for enhancing stability of a shooting position in the field take on many different shapes and forms depending on a particular need. There is a broad array of typically single- or limited-use accessories that includes those that find utility in their interaction with available structures. These include barricade stops for exerting stabilizing force against a particular structure, or saddle appliances that are usable to take advantage of configurations of sills, doorframes and the like.

The most commonly recognized and employed "free standing" stabilizing accessories are a class of systems and/or devices commonly referred to as monopods and bipods. A bipod, for example, is a two-legged mechanical apparatus that is usable to provide additional points of stability for the shooter. On firearms, bipods are commonly used on the long guns, including rifles and man-portable machine guns, to provide a forward rest that aids in reducing motion and creep while firing. Bipods permit shooters to rest a weapon on objects, like the ground or a wall. The additional points of stability afforded by the bipod apparatus provide, among other benefits, reduction in shooter fatigue, and a tendency toward significantly increased accuracy based on the mechanical stability the bipod provides. The bipod system or device provides significant stability along two axes of motion (side-to-side, and up-and-down), and depending on a configuration and operational employment (shooter positioning and use), can also provide some increased stability in a fore and aft direction.

Bipods come in a number of configurations. They are typically mounted to the forestock of the long gun by engaging a mounting rail, such as a Weaver rail or a Picatinny rail, or by engaging another fixed mounting receptacle on the forestock conforming with a compatible mounting block or other engagement portion on the "hip" or connecting portion of the bipod about which the legs may be made to rotate from a stowed position (typically parallel to the barrel of the firearm) and an operating position (extending substantially orthogonally with respect to an axis of the barrel of the firearm). The legs of the bipod can be of a fixed length, or may be configured to be independently adjustable in length to accommodate variations in their use, and the terrain or object on which the bipod is set for shooter stability.

In most common configurations, a bipod may be tilted, with a tilting point close to a central axis of the firearm barrel, allowing the field of fire of the weapon to be moved up and down in a vertical plane. In other configurations, the connecting portion of the bipod to the weapon may include a swivel, or at least some capacity to swivel, facilitating sweeping the field of fire right and left in a horizontal plane, while maintaining a level of stability for the shooter.

In substantially all conventional configurations, the bipod legs are folded, or foldable, for streamlined ability to move with the weapon without extensive projections, in one of three ways: (a) away from the shooter, and substantially parallel to an axis of the barrel in the "stowed" position; (b) toward the shooter, and again substantially parallel to the axis of the barrel, or (3) retractably into a vertical foregrip, leaving substantially only the protrusion of the foregrip itself to deal with. In such configurations, the combination of the connecting portion and the legs remains affixed to the firearm in operation and in carriage. As such, conventional configurations of even advanced bipod systems, tend to add significant weight, and a yet-protruding structure (even in a stowed position) attached underneath the forestock of the firearm.

Additionally, the presence of the legs, even in the stowed position, can restrict flexibility by being "in the way" in certain shooting scenarios. The presence of the stowed bipod legs does not necessarily lend itself to a shooting scenario in which barricade engagement by some manner of barricade stop may be preferred, or in which window sill/frame, or door frame, engagement with some manner of saddle stop or support mechanism may be preferred.

SUMMARY

It may be advantageous to provide a particularly-configured improved lightweight bipod system or device in which the legs, whether individually fixed or foldable with respect to a particularly-configured base or connection portion, may be removable from the base or connection portion. The legs of the bipod system or device then may be advantageously separately stowable with the bipod system, or apart from the bipod system, in order to potentially reduce the weight, and/or streamline the protruding profile/parts, of the bipod system or device remaining attached to the forestock of the firearm for carriage. Removability of the legs may otherwise enhance or increase the flexibility for the shooter in his or her ability to differentially employ the particularly-configured base or connection portion of the bipod system apart from legs as one or more of a barricade stop, or a sill or frame saddle stop.

Exemplary embodiments of the disclosed systems and devices may provide an improved combat- and/or field-employable bipod system or device uniquely configured with removable and separately stowable leg components.

In embodiments, the removable and separately stowable leg components, when inserted in the particularly-configured base or connection portion may be of a fixed or hinged structure with respect to the base or connection portion.

In embodiments, the removable and separately stowable leg components may be of a fixed length, come in sets of a plurality of pairs with multiple fixed lengths, or otherwise may be individually and/or independently adjustable in length in a manner that is intended to provide enhanced flexibility for the shooter in achieving enhanced stability across an array of shooting scenarios in varying operational employment environments.

In embodiments, the removable and separately stowable leg components may be particularly configured at an attachment point to be substantially "keyed" in a manner that provides for positive engagement with the base or connection portion in a single operating position, or selectably between multiple operating positions.

Exemplary embodiments may particularly configure the base or connection portion of the disclosed bipod system or device to provide a saddle mount for the firearm when employed, for example, through a window frame, over a fence or wall, or in other like structurally stabilized position, with the legs removed.

Exemplary embodiments may provide uniquely configured front and/or rear faces of the base or connection portion including pointed protrusions that the shooter can employ when shooting over a wall, against any rigid or immovable object including a tree, car, curb, mailbox and the like, or through a window or door frame by engaging the wall, object, window or door frame with the pointed protrusions on the front face of the connecting portion and "leaning in," or with the pointed protrusions on the rear face and pulling the firearm into the shooter to flexibly make use of the stability of the fixed structure through cooperative engagement with the one or more faces of the base or connection portion, unencumbered by the presence of the legs in the stowed or carriage position.

In embodiments, the front and/or rear faces of the base or connection portion, including the protrusions described above, may be integrally formed with the base or connection portion, or may be formed as individual (or sets of) removable and/or interchangeable face appliances mounted, or removably mountable, to compatible connecting points or mechanical receivers on front and rear portions of the base or connection portion.

In embodiments, at least one of the above-described compatible connecting points or mechanical receivers on front and rear portions of the base or connection portion may be configured or configurable to mount additional accessories including, but not limited to, finger grips, vertical foregrips, angled foregrips and other like devices for substantially providing a shooter with a broadest spectrum of available stabilizing components to broaden the range of shooting scenarios supported by the disclosed lightweight bipod system or device.

Exemplary embodiments may provide combinations of the above-listed configurations, devices, structures and/or accessories in a kit form, which may include compatible storage on the firearm or on the shooter, for the shooter to reconfigure the disclosed lightweight bipod system or device in the field in any manner that will allow the shooter to optimally employ the bipod system or device in the shooting environment as it is presented to the shooter.

These and other features, and advantages, of the disclosed systems and devices are described in, or apparent from, the following detailed description of various exemplary embodiments.

BRIEF DESCRIPTION OF THE DRAWINGS

Various exemplary embodiments of the disclosed detachable firearm accessory usable to enhance stability of a shooting position when attached to the forestock of a firearm, and to the unique configurations of a detachable leg bipod system or device for mounting via a compatible rail, or other attachment point, on the forestock of the firearm, will be described, in detail, with reference to the following drawings, in which.

DESCRIPTION OF EMBODIMENTS

Figure 1A:
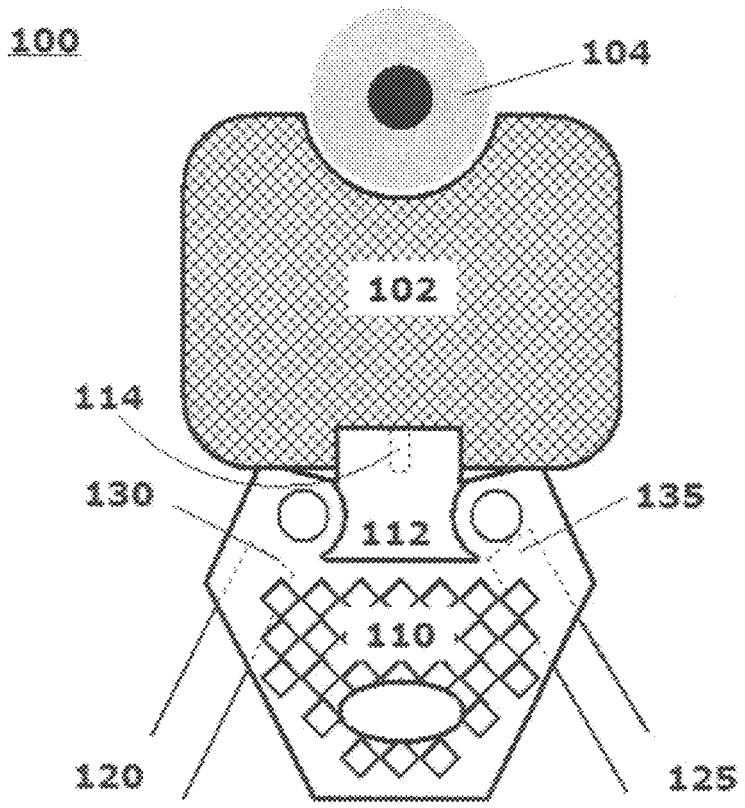
FIG. 1A illustrates a schematic diagram of a front view of a first exemplary embodiment of a detachable leg bipod system or device according to this disclosure mounted via a mechanical interconnection or attachment point on a forestock of a firearm.

The disclosed systems, methods and apparatus for enhancing shooter stability provide advanced bipod systems and devices of a unique configuration of a bipod specifically configured to have removable legs in order to increase the operational flexibility of the overall bipod system or device once attached to the firearm. The disclosed systems will be described as being particularly usable for the purposes of increasing shooter stability. This single real-world application for the system, method and apparatus according to this disclosure should, however, not be considered as limiting the disclosed embodiments to any particular operating or shooting scenario. Rather, the disclosed embodiments are intended to provide an overview of a particular real-world scenario for employment of such a system, method and/or apparatus. Any advantageous employment of a similarly-configured system or device that may be used to supplement the capacity of a shooter to produce an increasingly stable shooting position, advantageously employing the structures in the shooting environment to maximum advantage, that may benefit from the teachings of the disclosed embodiments is intended to be encompassed by the detailed description that follows. In this regard, and although particularly directed to bipod systems for long guns, one of skill in the art will appreciate that monopod and tripod systems for all types of firearms may benefit from the advantages of having removable leg configurations in the manner discussed with regard to the disclosed bipod systems and devices.

In embodiments, the disclosed systems and devices are configured, in operation, to function as a basic bipod for a tactical rifle. Uniquely, in the disclosed bipod systems and devices, the legs can be removed, for example, in instances when the full bipod structure is not needed. The term "basic"

is used in the preceding sentence to express the elegant simplicity of the disclosed design. Conventionally, a bipod provides stability, cant (yaw rotation), and adjustability of a length of the legs, as indicated above. The disclosed bipod systems and devices also provide stability, but forego cant, and adjustability of the legs, for simplicity. That said, in embodiments of the disclosed systems and devices, the bipod may be configured to maintain a capacity to "Sweep." Materials from which the detachable legs are formed may be carefully selected, and a configuration of the legs themselves, according to shape and thickness, may be implemented such that the legs may twist to allow the firearm some horizontal sweep. The physical phenomena may be akin to one standing with one's feet shoulder width apart. One could still sweep ones pelvis left and right based on an ability to twist ones legs without bending the legs.

An advantage of configurations according to this disclosure has to do with further differentiation of the disclosed bipod systems and devices from conventional bipods. For example, conventional bipods are heavy and bulky, and thus many tactical shooters do not use them. An ability to provide a sleek and comparatively lighter weight weapon is preferred tactically. The disclosed design of a bipod system or device provides the necessary benefits of a bipod that a tactical shooter needs removing any feature, beyond stability, which adds weight and bulk. The disclosed schemes allow the shooter to remove the legs entirely, minimizing the weight and bulk on the weapon.

The base or connection portion of the disclosed bipod systems and devices remains affixed to the forestock of the firearm and may function as a hand stop, and/or as a barricade stop, and in embodiments as a saddle stop for engagement with a sill or frame of a window or door, for example. Those of skill in the art recognize that the term "hand stop" refers to the capacity of the base or connection portion to operate as a fore-end block under the forestock of the firearm for the shooter's hand. The shooter's hand abuts a proximal side of the hand stop and is kept from moving beyond that point on the forestock when manipulating the firearm.

In order to operate as a barricade stop, the base or connection portion may be configured with fore-end or rear-end pointed protrusions or "teeth" to allow the shooter to gain stability when shooting from behind cover. The shooter pushes or pulls the barricade stop into the barricade and leans into the weapon, or pulls the weapon firmly against the barricade and into the shooter's shoulder/body, to improve stability.

The configuration of the disclosed bipod system and device allows the device to work as a barricade stop and a bipod, actually allowing the use for both, and in configurations, separately or additionally as a saddle stop. To accomplish these tasks with separate devices would require those separate devices to compete for location on the firearm. For example, the proper location for a bipod is as close as possible to a distal end of the forestock in order that stability is best enhanced. In like manner, the barricade stop or saddle stop also needs to be optimally as far out on the distal end of the forestock of the weapon as possible. In addition to improving stability, such placement minimizes the signature of the weapon beyond the barricade, for example. Furthermore, barricade stops are usually also hand stops, and if one would place the barricade stop in front of a normal bipod, assuming the barricade stop does not interfere with the legs folding, the hand stop function of the barricade stop would be eliminated. Separately, in scenarios in which a hand stop function of the barricade stop is replaced by the above-described reverse barricade stop function, a separate bipod would still interfere.

As is indicated above, conventional bipods have the base and the legs attached together and to remove the bipod the entire device must be removed. The disclosed bipod systems and devices allow the shooter to stow the legs or remove them entirely with a simple and fast pull action. In embodiments, the legs may be configured with a feature to facilitate the "loose" legs being snapped together in order that when off the firearm one does not get lost. In embodiments, a firearm end of the legs may be particularly configured to be inserted, and locked, into compatibly-configured receiver openings in the base or connection portion affixed to the forestock of the firearm.

Reference will be made to a substantially integral base or connection portion device that may be molded, or otherwise formed, of materials that will result in a substantially rigid structure with limitedly compliant openings for receiving the detachable leg components, and one or more substantially integrated faces including pointed protrusions to act as an integral barricade stop. The disclosed schemes may include techniques for forming such an integral base or connection portion from varying material compositions that may result in a substantially rigid or malleable surfaces to facilitate varying levels of structural engagement when employed as a barricade stop.

Exemplary embodiments described and depicted in this disclosure should not be interpreted as being specifically limited to any particularly limiting material composition for the composition of the device, either the base or connection portion, or the legs. As indicated above, for example, the legs may be formed of materials, and formed in configurations, that may provide complete rigidity, or that may provide a certain mechanical flexibility in order to support some level of mechanical sweep without necessitating additional swivel components associated with the base or connection portion. In embodiments, configurations of the base or connection portion may include various connected or connectable components such that no particular method for forming the base or connection portion as an integral structure may be implied as the structure may be in a form of an integrated structure having multiple connected components.

Further, the exemplary embodiments described and depicted in this disclosure should not be interpreted as specifically limiting the configuration of any of the component parts, or to any limiting dimensions as may be implied by the detailed description that follows. All references to particular configurations and/or employment scenarios are intended to be illustrative only and are not intended to limit the disclosed concepts, compositions, processes, techniques, methods, systems and devices in any manner. It should be recognized that any advantageous use of the disclosed structures and schemes for providing a capacity to anchor a particular firearm in a particular shooting position that may advantageously employ systems, methods, techniques, and processes such as those discussed in detail in this disclosure is contemplated as being included within the scope of the disclosed exemplary embodiments.

Figure 1B:
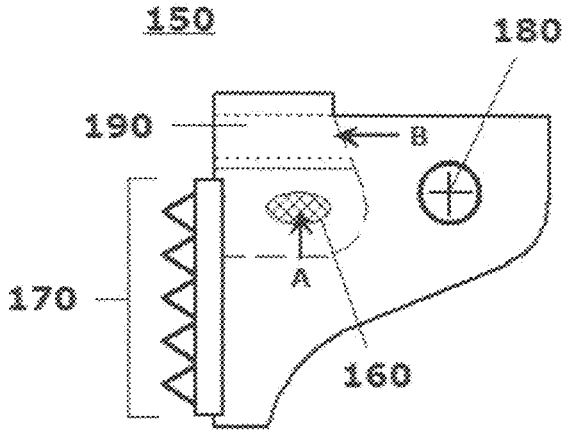
FIG. 1B illustrates a schematic diagram of a side view of a base or connection portion for the first exemplary embodiment of the detachable leg bipod system or device according to this disclosure.

FIG. 1A illustrates a schematic diagram of a front view 100 of a first exemplary embodiment of a detachable leg bipod system or device according to this disclosure mounted via a mechanical interconnection or attachment point on a forestock 102 of a firearm under a barrel 104 of the firearm. FIG. 1B illustrates a schematic diagram of a side view 150 of the base or connection portion of the first exemplary embodiment of the detachable leg bipod system or device according to this disclosure.

As shown in FIGS. 1A and 1B, the first exemplary embodiment of the detachable leg bipod system or device may include a base or connection portion 110 to facilitate mounting of the detachable leg bipod system or device to the forestock 102 of the firearm. The mounting may be through use of some form of mounting appliance 112 that includes one or more mechanical mounting and securing components 114, which may be in the form of, for example, one or more screws. Otherwise, the mounting to the forestock 102 of the firearm may be via a Weaver rail, a Picatinny rail or another fixed or sliding connection point on the forestock 102. These may include virtually any known connection system that could be made compatible to the base or connection portion 110, and the forestock 102, e.g., M-LOK, KeyMod, and the like, or even standard holes separated by 1". In embodiments, adaptation to any or all of these mounting "standards" may be via an attachment interface component, such as a particularly-configured mounting appliance 112. In embodiments in which the detachable leg bipod system or device may be mounted via a conventional rail system, a locking device 180, which may be in a form of a through bolt, may be provided.

As shown, in operation, detachable legs 120,125 may be inserted into conformal receptacles 130, 135. The legs may be inserted in direction A into receptacle 160. As indicated above, though securely inserted into the receptacles 130, 135, for stability, materials from which the detachable legs 120, 25 are formed may be carefully selected, and a configuration of the detachable legs 120,125 themselves, according to shape and thickness, may be implemented such that the legs may twist to allow the firearm some horizontal sweep. The detachable legs 120,125 may be formed of metals, composite materials, plastics and other like materials that may provide absolute rigidity, or some malleability in order to support the twisting described above. As will be indicated further below with respect to FIGS. 2A and 2B, firearm, or base or connection portion, engaging ends of the detachable legs 120,125 may be particularly configured to be inserted into the base or connection portion 110, and to be twisted or otherwise mechanically manipulated to be essentially "locked" in place.

For stowage on the firearm, the detachable legs 120,125 may be removed from the operational position in the receptacles 130,135 (or 160) and stowed by being inserted, for example, into receptacle 190 in direction B, or in a direction opposite direction B.

Details of the pointed protrusions 170 are shown in exemplary manner in the side view 150 depicted in FIG. 1B, as is a the screw or other tightening component 180. In this embodiment, the pointed protrusions 170 are in a form of small pyramids formed on a front face of the base or connection portion 110 for engaging the pointed protrusions 170 with a wall or other rigid or immovable object including a tree, car, curb, mailbox and the like, or through a window or door frame. With the pointed protrusions 170 engaging any such solid surface, the shooter can "lean in" to the surface, for example, for increased stability. This configuration is exemplary only. As will be described in detail below with respect to FIG. 3, such pointed protrusions 170 may be a portion of a separate appliance rather than being integrally formed with a face of base or connection portion 110, and such integral formation of the pointed protrusions 170, or attachment of such a separate appliance, may not be limited to a forward end of the base or connection portion 110. Also, as will be shown and described in detail with respect to FIG. 3 below, in embodiments, a configuration of the bottom of the base or connection portion 110 may facilitate use of the base or connection portion 110 as a saddle mount in certain shooter scenarios with the detachable legs 120,125 removes and/or stowed.

Figure 2A:
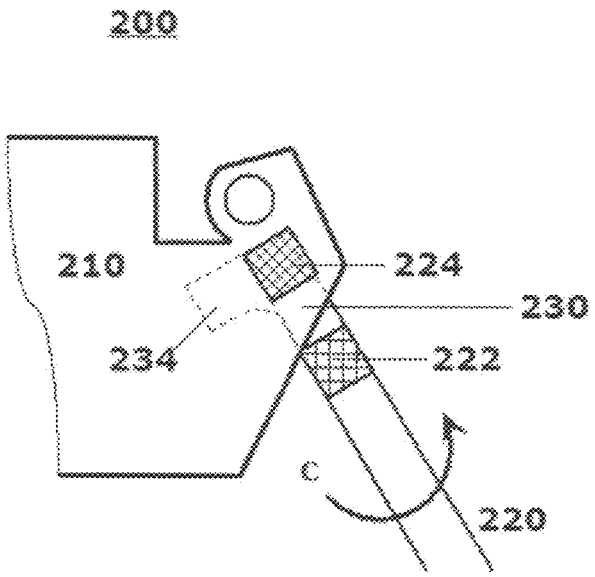
FIG. 2A illustrates a schematic rear view of a portion of a second exemplary embodiment of a detachable leg bipod system or device with a uniquely structured leg assembly according to this disclosure.
Figure 2B:
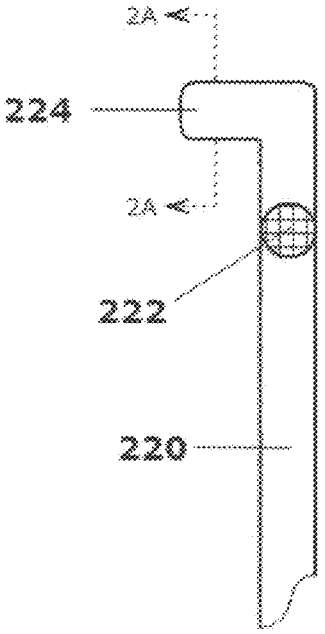
FIG. 2B illustrates a schematic diagram a cutaway portion of an exemplary embodiment of a uniquely structured leg assembly usable with the second exemplary embodiment of the detachable leg bipod system or device according to this disclosure.

FIG. 2A illustrates a schematic rear view 200 of a second exemplary embodiment of a rear view of a portion of a detachable leg bipod system or device with a uniquely structured leg assembly 220 according to this disclosure. FIG. 2B illustrates a schematic diagram a cutaway portion of the uniquely structured leg assembly 220 usable with the second exemplary embodiment of the detachable leg bipod system or device according to this disclosure.

As shown in FIGS. 2A and 2B, the uniquely structured leg assembly 220 may include at least one protrusion 224 that may be inserted into a compatibly configured receptacle 230 in the base or connection portion 210, the receptacle 230 including, for example, an extended portion 234 that is configured to accommodate the at least one protrusion 224 on the uniquely structured leg assembly 220 inserted into the base or connection portion 210.

Once inserted to its full depth within the compatibly configured receptacle 230 in the base or connection portion 210, the uniquely structured leg assembly 220 may be rotated about its axis, for example, 90° in direction C, in order to be "locked in" to a substantially final and stably engaged position, as shown in FIG. 2A. It should be noted that the cutaway lines shown in FIG. 2B are intended to render FIGS. 2A and 2B clear as to a final configuration of the uniquely structured leg assembly 220 in the compatibly configured receptacle 230 of the base or connection portion 210.

In embodiments, the uniquely structured leg assembly 220 may include a hinge device 222, whereby the uniquely structured leg assembly 220 may not need to be removed from the base or connection portion 210 in order to be "stowed" in a non-firing position. The presence of such a hinge device 222 may increase operational and tactical flexibility and speed and ease of manipulation of particular configurations of unique structured leg assemblies 220 for shooters employing embodiments of the disclosed bipod systems and/or devices in the field.

Figure 3:
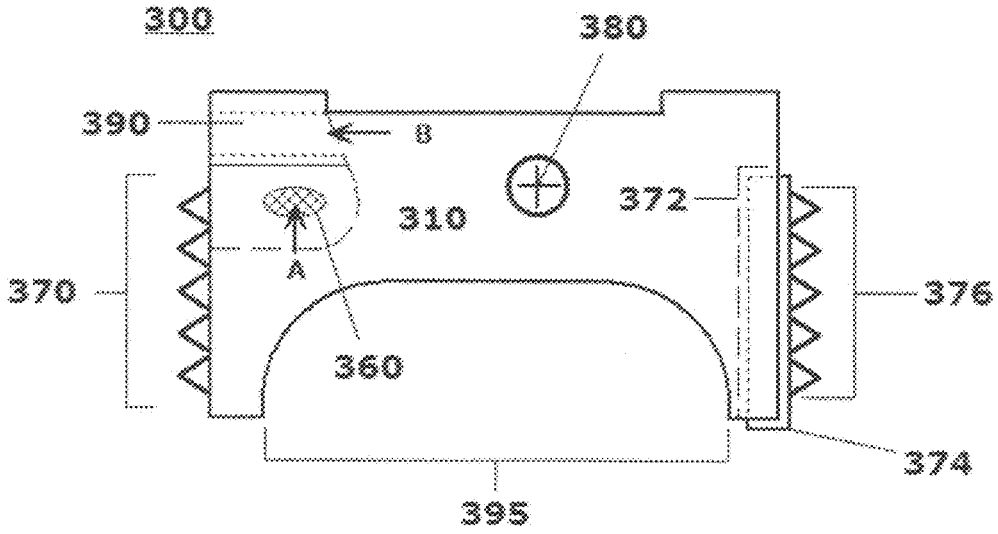
FIG. 3 illustrates a schematic diagram a side view of a base or connection portion for a third exemplary embodiment of a detachable leg bipod system or device according to this disclosure.

FIG. 3 illustrates a schematic diagram a side view 300 of a third exemplary embodiment of a base or connection portion for a detachable leg bipod system or device according to this disclosure. As shown in FIG. 3, the third exemplary embodiment of the detachable leg bipod system or device may include a separate configuration of the base or connection portion 310 to facilitate mounting of the detachable leg bipod system or device to the forestock of the firearm. As with the embodiment in FIGS. 1A and 1B the mounting may be through use of some form of mounting appliance that includes one or more mechanical mounting and securing components. Otherwise, the mounting to the forestock of the firearm may be via a Weaver rail, a Picatinny rail or another fixed or sliding connection point on the forestock. In embodiments in which the detachable leg bipod system or device may be mounted via a conventional rail system, a locking device 380, which may be in a form of a through bolt, may be provided.

The detachable legs may be inserted into one or more conformal receptacles 360 in direction A into receptacle 160. As was described above with respect to FIGS. 2A and 2B, the base or connection portion 310 may be particularly configured to accept the legs being inserted and twisted or otherwise mechanically manipulated to be essentially "locked" in place. For stowage on the firearm, the detachable legs may be removed from the operational position inserted in receptacle 360 and stowed by being inserted, for example, into receptacle 390 in direction B, or in a direction opposite direction B.

Details of the pointed protrusions 370 integrally formed in a "front" face are shown in exemplary manner in the side view 300 depicted in FIG. 3. In this embodiment, the pointed protrusions 370 are in a form of small cones formed in the front face of the base or connection portion 310 for engaging the pointed protrusions 370 with a wall or other rigid or immovable object including a tree, car, curb, mailbox and the like, or through a window or door frame.

As shown further in FIG. 3, pointed protrusions 376 may be a facial portion of a separate appliance 374 that may be mounted, or mountable, in or on the base or connection portion 310 via some form of compatible receiver opening 372 in the "rear" face of the base or connection portion 310. In any instance, either mounting scheme may be used in either of the front face, the rear face or both. Put another way, integral formation of the pointed protrusions 370, or attachment of such a separate appliance 374 may not be limited to a forward face and/or rear face of the base or connection portion 310. Also when presented as separate components, configurations and sizes of the separate appliances 374, and materials from which the appliances 374 and/or the protrusions 376 may be formed may be selected to be rigid, or malleable.

In embodiments, a configuration of the bottom of the base or connection portion 310 may provide a saddle-like area or gap 395 for use of the base or connection portion 310 as a saddle mount or saddle stop in certain shooter scenarios.

Figure 4:
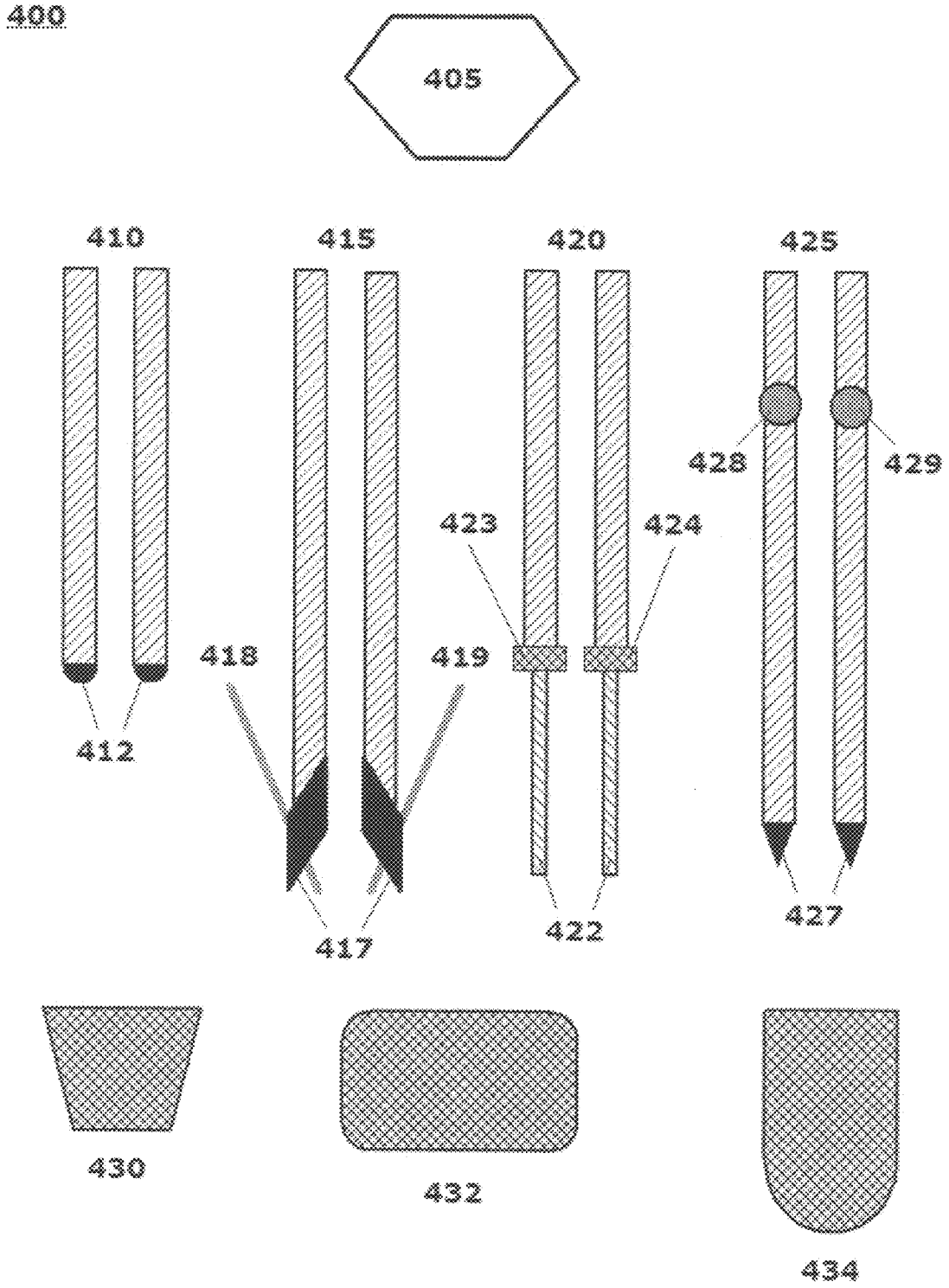
FIG. 4 illustrates a schematic diagram of a kit form of a set of varying accessories that may be usable to constitute a detachable leg bipod system or device according to this disclosure.

FIG. 4 illustrates a schematic diagram of a kit form 400 of a set of varying accessories that may be usable to constitute a detachable leg bipod system or device according to this disclosure. The base or connection portion 405 may be provided in any one or more of the configurations and with any of the fixed or movable features described above. Pairs of compatible detachable legs 410,415,420,425 may be provided as full sets or in any combination thereof.

First exemplary compatible detachable legs 410 may be comparatively shorter and may be configured with rounded distal tips 412. Second exemplary compatible detachable legs 415 may be comparatively longer and may be configured with pointed distal tips 417, which may be optionally configured with one or more through holes to accommodate, for example, stakes, pegs, pins or other like mechanical components 418,419 that may be usable to stake, peg, pin or otherwise secure the pointed distal tips 417 to a particular surface. Third exemplary compatible detachable legs 420 may be configured with extendable components 422, which may be released, or otherwise locked in place, through manipulation of lockable components 423,424. In these embodiments, the detachable legs 420 may be flexibly employed to accommodate tilted, or otherwise uneven, surfaces. The extendable components 422 may be similarly, or differentially, extended to accommodate the contours of the stabilizing surface. Fourth exemplary compatible detachable legs 425 may be separately configured with hinge components 428,429 about which distal portions of the compatible detachable legs 425 may be manipulated in use. In these embodiments, the detachable legs 425 may be configured with other configurations of pointed distal tips 427.

Although depicted individually with the above-indicated discrete features, and combinations of features, it should be recognized that any combination of the features described generally above with respect to the configuration of any pair of exemplary compatible detachable legs may be interchanged in any reasonable manner so as to facilitate a broadest combination of selectable features available to a particular shooter, including to his or her personal preferences.

A series of changeable barrier stop appliances 430-434 may be provided separately or additionally to the varying sets of compatible detachable legs for mounting on a front face or a rear face of the base or connection portion 405 in the manner described above. The changeable barrier stop appliances may include a relatively smaller conformal barrier stop appliance 430, a relatively larger flat face barrier stop appliance 432, a substantially rounded barrier stop appliance 434 (which may present a semicircular rounded array of pointed projections in a singular axis, or in multiple axes, for flexibility in engagement of any barrier. These descriptions of examples of the series of changeable barrier stop appliances are intended to be illustrative only, and not limiting to broad variations in configurations of such attachable barrier stop appliances as may be imagined by one of skill in the art.

Those skilled in the use of firearms and the many and widely varied fields of endeavor surrounding such use will appreciate that other embodiments of the disclosed subject matter may be practiced in many disparate configurations of systems or devices, techniques, processes and/or employment schemes, including various structural components for providing flexibility in stabilization of a firearm in marksmanship and/or tactical employment scenarios.

The exemplary depicted combinations of features represent just examples of how those features may be imaginatively combined to achieve the objectives outlined in this disclosure. No particular combination of a particular set of features is necessarily implied by any of the depictions in FIGS. 1-4, except where it may reasonably be understood that a particular feature may provide a necessary condition for integration of any other feature.

Although the above description may contain specific details, they should not be construed as limiting the claims in any way. Other configurations of the described embodiments of the disclosed systems, methods, apparatus, devices, schemes and/or techniques are part of the scope of this disclosure. For example, the principles of the disclosed embodiments may be applied to each individual shooter where each shooter may individually employ some variation of the disclosed detachable leg bipod, as needed, according to one or more of the multiply depicted configurations, or sets of features. This enables each shooter to make use of the benefits of the disclosed embodiments even if any one of a large number of possible applications do not need all of the described functionality. In other words, there may be multiple instances of the disclosed systems and devices each being separately employed in various possible ways at the same time where the actions of one shooter, and that shooter's personal preferences with regard to the included features, does not affect the actions of other shooters using separate and discrete embodiments with other combinations of available features.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

We claim:

1. A firearm accessory, comprising:

a base component with an attachment part that attaches the base component to a portion of a firearm, and at least a first pair receptacles that are configured to extend orthogonally to an axis of a barrel of the firearm when the attachment part attaches the base component to the portion of the firearm; and a pair of removable legs that are configured to be inserted into the at least the pair of receptacles in the base component in a manner that that forms a bipod for stabilizing the firearm, the base component further comprising a plurality of protrusions extending from a front face and a rear face of the base component in a direction substantially parallel to the axis of the barrel of the firearm when the base component is attached to the firearm.

2. The firearm accessory of claim 1, the base component further comprising at least a second pair receptacles that are configured to receive the pair of removable legs in a position substantially parallel to the axis of the barrel of the firearm.

3. The firearm accessory of claim 1, the plurality of protrusions being integrally formed with the front face of the base component.

4. The firearm accessory of claim 1, the plurality of protrusions being a portion of a separate appliance that is configured to be attached to the rear face of the base component.

5. The firearm accessory of claim 1, the plurality of protrusions being pointed in a direction away from the front face of the base component.

6. The firearm accessory of claim 5, the plurality of protrusions being in a substantially pyramid shape with a base of the pyramid facing the front face of the base component, and the point of the pyramid extending away from the front face of the base component.

7. The firearm accessory of claim 5, the plurality of protrusions being in a substantially conical shape with a base of the conical shape facing the front face of the base component, and the point of the conical shape extending away from the front face of the base component.

8. The firearm accessory of claim 1, each one of the pair of removable legs having a substantially circular cross-section when viewed from an axial end of the each one of the pair of removable legs.

9. The firearm accessory of claim 1, each one of the pair of removable legs having a substantially square cross-section when viewed from an axial end of the each one of the pair of removable legs.

10. The firearm accessory of claim 1, each one of the pair of removable legs having a configuration at an end received by the at least one of the pair of first receptacles that provides positive mechanical engagement between the each one of the pair of removable legs and the at least one of the pair of first receptacles.

11. The firearm accessory of claim 10, the positive mechanical engagement resulting from a force fit of the end of the one of the pair of removable legs with the at least one of the pair of first receptacles.

12. The firearm accessory of claim 10, the positive mechanical engagement requiring a 90° turn of the at least one of the pair of removable legs after full insertion into the at least one of the pair of first receptacles.

13. The firearm accessory of claim 1, the attachment part being configured to be compatible with at least one of a Weaver rail and a Picatinny rail.

14. The firearm accessory of claim 13, the attachment part further comprising at least one mechanical tightening device to tighten the attachment part with respect to the at least one of the Weaver rail and the Picatinny rail.

15. The firearm accessory of claim 1, the attachment part being configured as a mounting block for mechanical attachment of the base component to a compatibly configured portion of the firearm.

16. A firearm accessory, comprising:

a base component with an attachment part that attaches the base component to a portion of a firearm, and at least a first pair receptacles that are configured to extend orthogonally to an axis of a barrel of the firearm when the attachment part attaches the base component to the portion of the firearm; and a pair of removable legs that are configured to be inserted into the at least the pair of receptacles in the base component in a manner that that forms a bipod for stabilizing the firearm, the base portion further comprising a facial surface opposite the attachment part that is formed in a shape of an inverted saddle with protrusions at front and rear positions extending orthogonally in a direction away from the barrel of the firearm when the base portion is attached to the firearm.

17. The firearm accessory of claim 16, the pair of removable legs comprising multiple pairs of removable legs, each of the multiple pairs of removable legs having a different length in an axial direction.

18. The firearm accessory of claim 16, each of the pair of removable legs comprising:

a first portion that is configured to engage with the each of the first pair of receptacles in the base component;

a second portion located at a distal end of the first portion and that is configured to be at least partially retractable within the first portion; and a locking component that is configured to immobilize the second portion with respect to the first portion when the user sets the second portion at a particular length with respect to the first portion.

19. The firearm accessory of claim 16, each of the pair of removable legs comprising:

a first portion that is configured to engage with the each of the first pair of receptacles in the base component;

a second portion located at a distal end of the first portion; and a swivel component that is configured to connect to the first portion to the second portion and to selectably allow the second portion to be rotated between a shooting position substantially orthogonal to the axis of the barrel of the firearm and a carriage position substantially parallel to the axis of the barrel of the firearm.

* * * * *